United States Patent [19]

Glover

[11] 4,408,436

[45] Oct. 11, 1983

[54] CASE PACKER FOR INVERTING BOTTLES AND DEPOSITING THEM IN A CASE

[75] Inventor: Charles G. Glover, Cincinnati, Ohio

[73] Assignee: The Lodge & Shipley Company, Cincinnati, Ohio

[21] Appl. No.: 266,511

[22] Filed: May 22, 1981

[51] Int. Cl.[3] ..... B65B 39/00; B65B 5/08

[52] U.S. Cl. ..... 53/247; 53/248

[58] Field of Search ..... 53/247, 248, 262, 446, 53/443, 544, 537, 539, 543; 193/32

[56] References Cited

U.S. PATENT DOCUMENTS

| | | | |
|---|---|---|---|
| 1,611,822 | 12/1926 | Dulche | 53/248 X |
| 2,342,369 | 2/1944 | Ransbottom | 53/248 X |
| 3,034,626 | 5/1962 | Kay | 193/32 |
| 3,404,509 | 10/1968 | Schaewe et al. | 53/247 X |
| 4,259,826 | 4/1981 | Campbell | 53/248 X |
| 4,277,932 | 7/1981 | Campbell | 53/248 X |

FOREIGN PATENT DOCUMENTS

| | | | |
|---|---|---|---|
| 562460 | 6/1977 | U.S.S.R. | 53/248 |

*Primary Examiner*—Horace M. Culver

*Attorney, Agent, or Firm*—Wood, Herron & Evans

[57] ABSTRACT

A case packer for packing bottles from an upright position to a necks down or upside down position in a case. A grid is provided for marshalling upright bottles and a conveyor is provided for bringing a case, to be packed, under the grid. A rotator, located between the grid and case, is adapted to receive a pattern of bottles from the grid, rotate the bottles to invert them, and then deposit the bottles into the case. Gripping devices are located above the grid to grasp the tops of the bottles on the grid and push them into the rotator. After a first pattern of bottles has been inserted into the rotator and held there by a frictional arresting device, the second set of bottles forces the first set through the rotator and into the case.

3 Claims, 8 Drawing Figures

CASE PACKER FOR INVERTING BOTTLES AND DEPOSITING THEM IN A CASE

This invention relates to a case packer and more particularly to apparatus for packing bottles upside down or necks down in a case.

In many plants where bottles are filled with product, the bottles are received in cases from the manufacturer prior to filling. It is customary to unload such boxes, by hand, onto conveyors for further processing. If the bottles have been packed into the cases in an upright position, the bottles must be removed almost individually, by hand, and placed on the conveyor. On the other hand, if the bottles have been packed upside down or necks down in the cases, then in depositing the bottles onto the conveyor the operator merely has to turn the case upside down onto the conveyor and let the bottles drop out by means of gravity. Thus, it is valuable in many instances to be able to pack bottles in a necks down orientation.

Other plants, however, may desire to have their bottles packed in an upright orientation so that they can be handled by automatic machinery which grips the necks of the bottles. It is in many instances desirable for a bottle manufacturer to have the capability of packing bottles in either orientation so that they can be handled by automatic machinery which grips the necks of the bottles and lifts them out of their respective cases. In order to avoid the cost of providing two different types of packers, one for necks up and for one necks down, it has been an objective of the present invention to provide a packer wherein bottles may be packed necks up or necks down on the same apparatus with only a minor modification.

It is a further objective of the invention to provide apparatus for receiving bottles in an upright orientation and packing them in a necks down orientation, the apparatus being a very simple and efficient mechanism.

These objectives are attained by providing a somewhat conventional case packer having a grid upon which a pattern of bottles is marshalled, a conveyor below the grid for positioning incoming empty cases below the grid and bottle gripping devices for grasping the necks of bottles and lowering the bottles through the grid into the case. In accordance with the present invention, a rotator is interposed between the grid and the case conveyor, the rotator having pockets lined with soft bristles for frictionally retaining the lightweight plastic bottles.

In the operation of the machine, bottles are marshalled into the desired pattern on the grid and grasped by the gripping devices. The grid is shifted to permit the bottles to move through it, and the bottles are lowered by the gripping devices into position in the rotator. There, the bottles are frictionally held by the bristles and the rotator is rotated through an angle of 180° in order to invert the pattern of bottles. Thereafter, a second pattern of bottles is marshalled on the grid, gripped by the gripping devices, and lowered into engagement with the first pattern of bottles in the rotator. As the second pattern continues a downward movement to position them within the rotator, they force the first pattern of bottles downward in a neck down orientation into the case. When the second pattern of bottles is thus frictionally lodged within the rotator, the rotator is rotated, new bottles are marshalled and the cycles of operation continue.

It can be appreciated that not only does the invention provide for the inverting of bottles in the case packing operation, but additionally provides for a very efficient operation in that with each 180° of rotation, a full pattern of bottles can be packed into the cases. There is no need for the rotator to return to its original state in order to pack a succeeding pattern of bottles.

Further, it can be appreciated that simply by effecting the removal of the rotator and replacing it with a conventional guide having fingers for aligning case cells, it is possible to pack bottles in an upright attitude in the cases. With the rotator removed, the gripping devices simply lower the bottles into the cases without the intermediate inversion step.

A further feature of the invention has been in the provision of the bristles for frictionally supporting the bottles in the cases. The bristles provide a very effective frictional grip for the lightweight plastic bottles and create minimum abrasion to the graphics on the bottle as the bottles are forced through the bristles.

The several objectives and features of the invention will become more readily apparent from the following detailed description taken in conjunction with the accompanying drawings in which.

Figure 1:
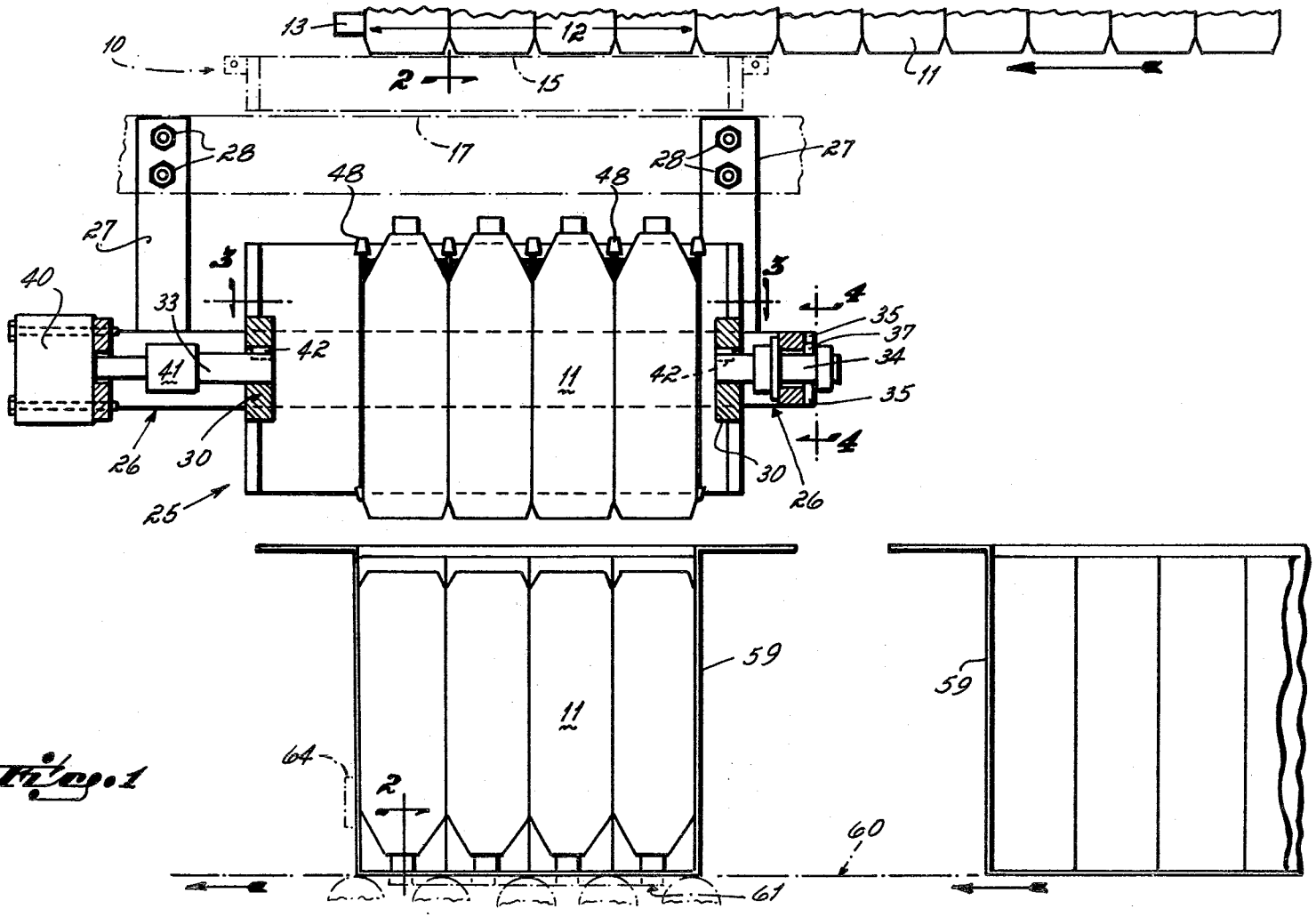
FIG. 1 is a fragmentary, side elevational view of a case packer employing the present invention.

Referring to FIG. 1, the case packer includes a grid 10 upon which bottles 11 are marshalled into a pattern indicated at 12, which in the illustrated form of the invention is a 3×4 pattern of bottles. A detector 13 is provided to indicate to the machine that all lanes are full so that a pattern has been completed and a cycle of operations may begin.

Figure 2:
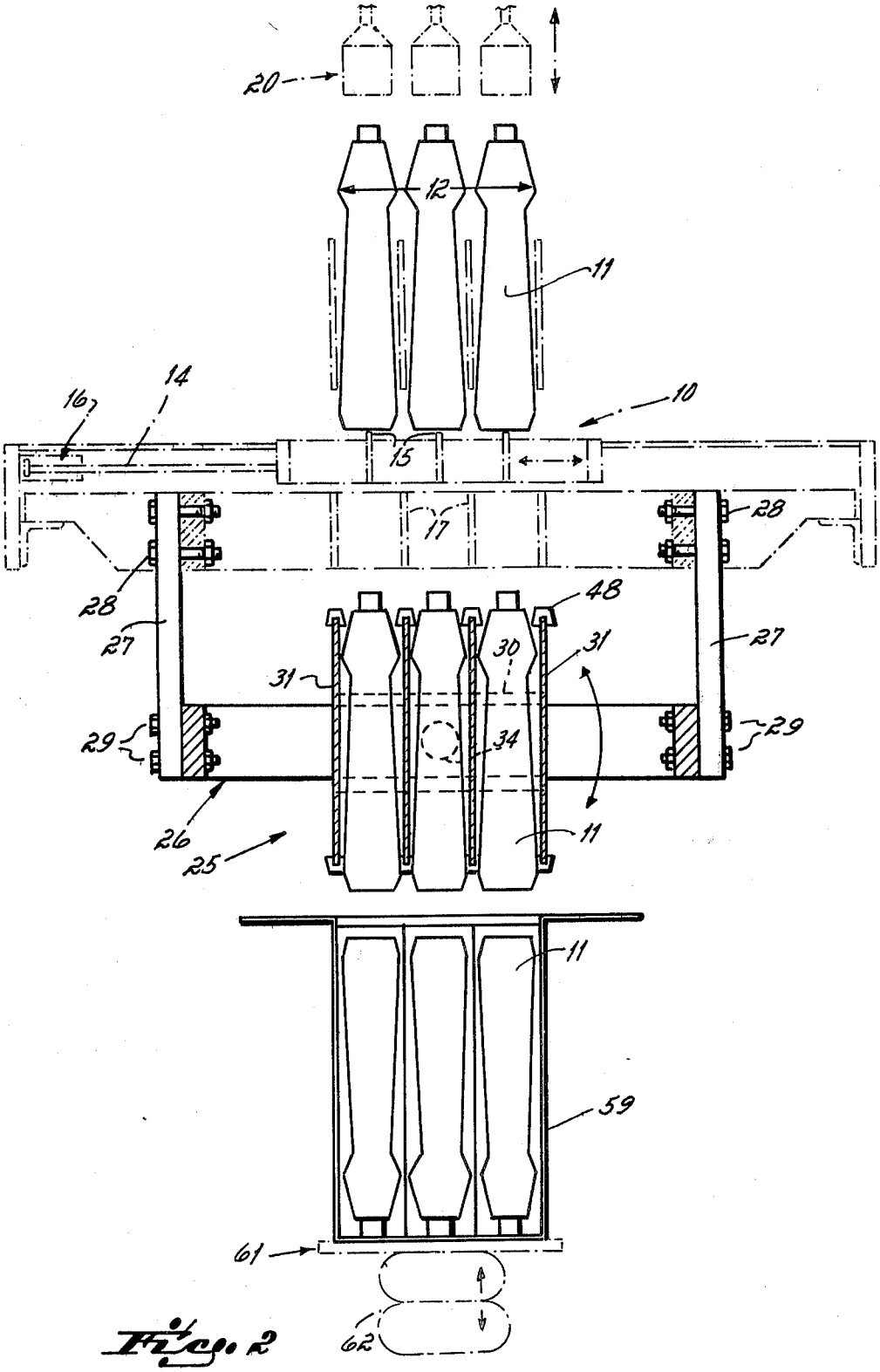
FIG. 2 is an end elevational view partly in section of the apparatus.

The grid, as best shown in FIG. 2, has three laterally reciprocable rails 15 with a piston and cylinder combination 16 connected to the rails by a rod 14 for shifting the rails to the right, as shown in FIG. 2, in order to create passages for the bottles.

Below the grid rails 15 are guide rails 17 to maintain a substantially vertical orientation of the bottles as they are lowered through the grid.

Above the grid, as best shown in FIG. 2, are bottle gripping devices 20, (as, for example, in McHugh U.S. Pat. No. 2,873,996) each adapted to grip the neck of an individual bottle and hold it securely as the bottle is being lowered through the grid.

Below the grid is a rotator 25 mounted in a frame 26 which is in turn supported by depending posts 27 connected at their upper ends, by nuts and bolts 28, to the structure immediately underneath the grid 10. The frame 26, carrying the rotator, is secured to the posts 27 by bolts 29. The rotator is removable simply by removing the bolts 29 and removing the rotator from the packer structure.

Figure 3:
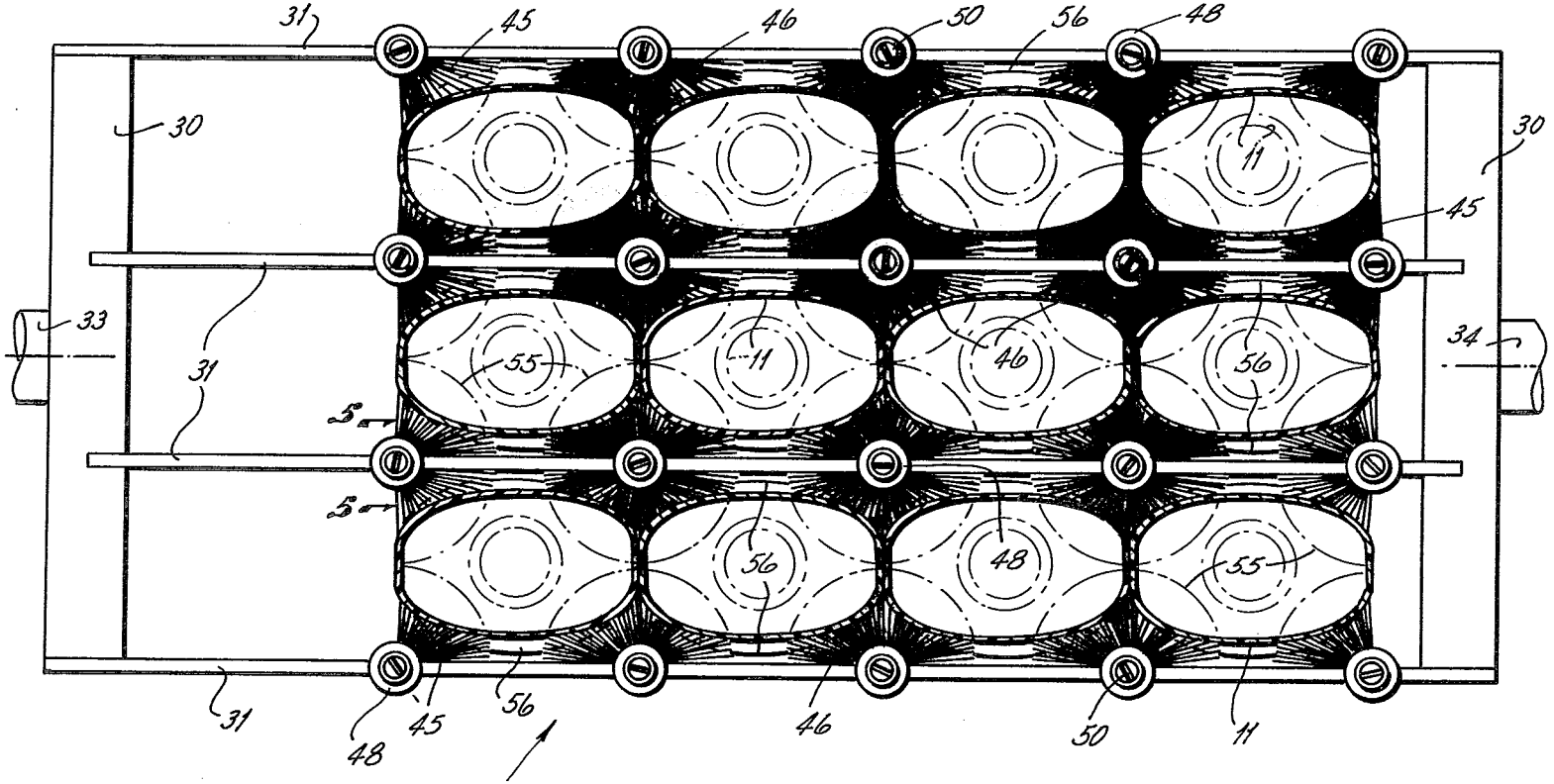
FIG. 3 is a cross-sectional view taken along lines 3—3 of FIG. 1.
Figure 4:
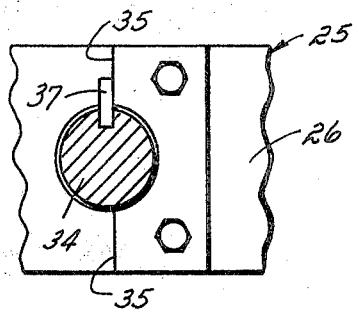
FIG. 4 is a cross-sectional view taken along lines 4—4 of FIG. 1.

The rotator as shown in the plan view of FIG. 3 has a pair of parallel end bars 30 to which pocket forming guide bars 31 are mounted in spaced parallel relation.

Each end bar has a shaft 33 and 34, respectively, projecting from it. The shaft 34 is journalled in the frame 26. An upper and lower stop 35 is provided on the frame 26 and a pin 37 is mounted on the shaft 34 for engagement with the stops 35. The stops 35 and pin 37 cooperate to stop the rotation of the rotator at its two vertical positions 180° apart.

The shaft 33 is journalled in the frame 26 at the opposite side. It is connected to a rotary actuator 40 which is mounted on the frame 26. A coupling 41 may be provided to join two sections of the shaft 33 so as to permit the mounting of different sized rotators in the packer in order to accommodate different patterns of bottles.

The shafts 33 and 34 are connected to the end bars 30 by means of keys 42 as shown in FIG. 1.

Figure 5:
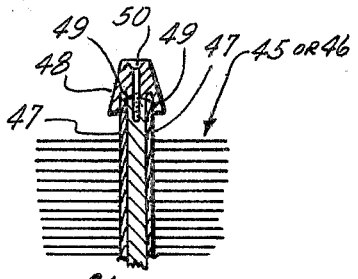
FIG. 5 is a cross-sectional view taken along lines 5—5 of FIG. 4; and FIGS. *6a*, *6b* and *6c* are diagrammatic illustrations of the sequence of operations of the invention.
Figure 6A:
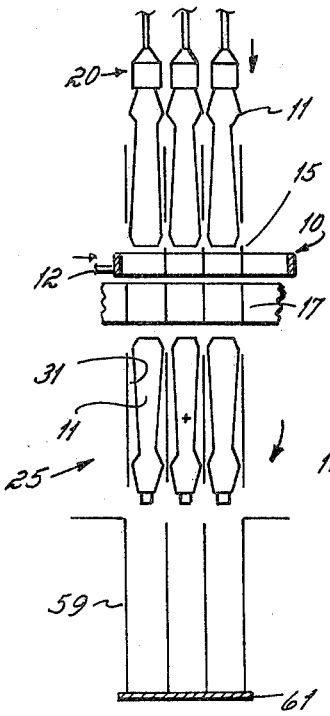
Figure 6B:
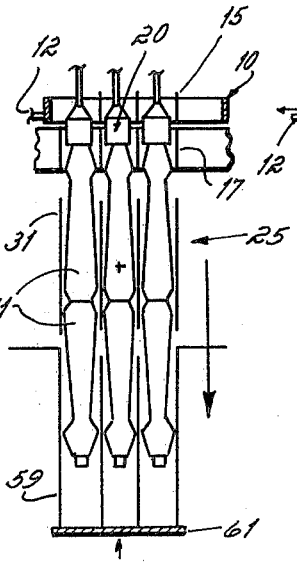
Figure 6C:
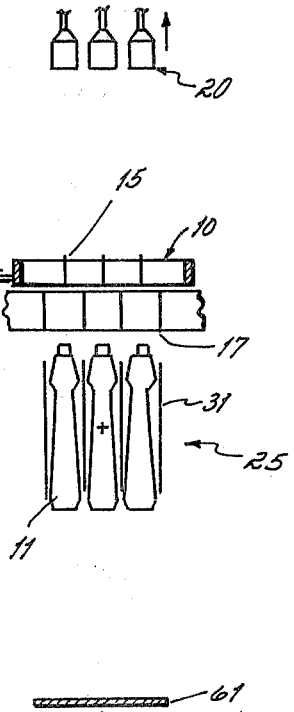

Bristles or brushes are attached to the rotator between adjacent bars 30 as shown at 45 and 46, brush 45 being formed as a quarter brush and brush 46 being formed as a half brush. The bristles extend substantially the full height of the dividers 31 as shown in FIGS. 1 and 5. The brushes are formed by mounting the bristles on a stem 47 (FIG. 5). Upper and lower caps 48 have recesses 49 to receive the stems 47 from adjacent brushes. A screw 50 threaded through the top of the cap and into a threaded hole in the divider 31 secures the cap and brush stems to the divider 31. At the outermost position of the rotator, only quarter sized brushes 45 are required, whereas in the inner positions, semi-circular brushes 46 are required.

It can be seen from viewing FIG. 3, and particularly the phantom lines 55, that the bristles normally extend well into the space between adjacent dividers 31 and are pushed back by the introduction of a bottle 11 into the pocket created by the bristles at the four corners of each bottle position in the rotator. It can also be appreciated that bottle dimension variation can be tolerated by the rotator, as indicated by the larger portion of bottle 11 by the lines 56, in view of the flexibility of the bristles 45 and 46.

Below the grid in a case conveyor 60 and a case elevator 61 operated by an air cushion of the type shown in U.S. Pat. No. 3,307,328. Cases 59 are brought into the packing apparatus against a stop 64 by the conveyor 60. There, the elevator 61 raises the case slightly above the conveyor so that the conveyor can continue to run during the packing operation.

In the operation of the invention as seen in FIGS. 2 and *6a–6c*, a first pattern 12 of bottles is marshalled into position above the grid 10. The necks of the individual bottles are gripped by the gripping devices 20. The grid 10 is shifted laterally to enable the bottles to pass between the rails 15. The gripping devices 20 thereupon lower the bottles into the rotator until they assume the position shown in full lines in the drawings in FIG. 2. After the gripping devices release the bottles and rise out of the way of the rotator, the rotator 25 rotates through 180° as caused by the actuator 40 and the pin 37 acting against the stop 35. The bottles then have the orientation shown in FIG. *6a*. In the meantime, a fresh pattern 12 of bottles 11 has moved into position on the grid. As soon as those bottles are in position, the gripping devices 20 grasp the bottles and lower them through the grid and guides 17 into engagement, bottom to bottom, with the first pattern of bottles in the rotator. Continued lowering of the second pattern of bottles into the rotator forces the first pattern of bottles downwardly into the case 59.

After the case 59 is loaded, the gripping devices retract as shown in FIG. *6c*, the grid rails 15 shift back to their interfering position of FIG. 2, also as shown in FIG. *6c*, and the case elevator 61 lowers to receive a fresh case. The rotator 25 is then rotated to the attitude of FIG. *6a* and the cycle of operations is repeated.

In the foregoing description of operations, it can be seen that bottles which are originally brought into the apparatus in an upright position as shown in FIGS. 1 and 2 are deposited into the cases 59 in an inverted position as shown in FIGS. 1 and 2. It can also be observed that while the rotator 25 is being actuated, a new pattern of bottles is being brought into a position underneath the grippers and onto the grid 10 for further loading operation so that there is little time lost between operations in order for elements to return to their original positions.

Finally, it can be observed that the apparatus can be converted to a more conventional drop packer simply by the removal of the rotator structure and replacing it with a conventional grid having cell aligning fingers. It might be required to alter the stroke of the case elevator to bring it higher or to change the stroke of the grippers to cause them to move farther in a downward direction, or both, in order to permit the grippers to deposit the bottles fully into the cases below.

Having described my invention, I claim:

1. In a case packer apparatus for loading bottles upside down in a case comprising, a grid, means for marshalling a pattern of bottles on said grid, means for positioning a case below said grid, a bottle rotator located below said grid for receiving a pattern of bottles and rotating said pattern of bottles through 180° to turn them upside down, bottle gripping means normally located above said grid and adapted to grasp bottles marshalled on said grid and lower them through said grid into said rotator, dividers creating a plurality of pockets in said rotator, bristles lining at least a portion of said dividers and creating a space within said pockets substantially smaller than the outside dimension of each bottle, whereby bottles positioned in said rotator will be frictionally retained after being released by said bottle-gripping means, said bottle gripping means forcing earlier positioned bottles through said rotator and into said case while positioning a fresh pattern of bottles in said rotator.

2. Apparatus as in claim 1 in which said bristles comprise, a plurality of spaced parallel brushes, secured to said dividers, said brushes defining vertical passageways through which said bottles are forced by said gripping means.

3. Apparatus as in claim 1 wherein said rotator is removable to permit packing bottles in a right side up orientation.

* * * * *